US007694378B2

(12) United States Patent
Tsurukawa et al.

(10) Patent No.: US 7,694,378 B2
(45) Date of Patent: Apr. 13, 2010

(54) INTERDENTAL BRUSH

(75) Inventors: Naoki Tsurukawa, Takatsuki (JP); Hidekuni Takano, Takatsuki (JP); Hirohisa Nakatsuka, Takatsuki (JP)

(73) Assignee: Sunstar, Inc., Osaka (JP)

( * ) Notice: Subject to any disclaimer, the term of this patent is extended or adjusted under 35 U.S.C. 154(b) by 970 days.

(21) Appl. No.: 10/567,183

(22) PCT Filed: Nov. 11, 2004

(86) PCT No.: PCT/JP2004/016727

§ 371 (c)(1),
(2), (4) Date: Feb. 3, 2006

(87) PCT Pub. No.: WO2005/046388

PCT Pub. Date: May 26, 2005

(65) Prior Publication Data

US 2008/0044791 A1 Feb. 21, 2008

(30) Foreign Application Priority Data

Nov. 13, 2003 (JP) ..... 2003-383772

(51) Int. Cl.
*A61C 15/02* (2006.01)
*A46B 7/02* (2006.01)
*A46B 9/04* (2006.01)

(52) U.S. Cl. ..... 15/167.1; 15/172; 132/321; 132/329; 433/141

(58) Field of Classification Search ..... 15/167.1, 15/172, 206; 132/321, 329; 433/141
See application file for complete search history.

(56) References Cited

FOREIGN PATENT DOCUMENTS

| | | |
|---|---|---|
| JP | 2000-23749 | 1/2000 |
| WO | WO 94/21152 | 9/1994 |

*Primary Examiner*—Mark Spisich
(74) *Attorney, Agent, or Firm*—Michael Best & Friedrich LLP

(57) ABSTRACT

The present invention provides an interdental brush and a cap, said brush having a good handling property and a low manufacturing cost, said brush being stored with the cap on while adjusting the brush body at any angle. The handle member 3 supporting the brush body 2 includes a handle body 6, an arm 12 extending from one end of the handle body 6, a brush support 13 that holds a base of the brush body 2, a first hinge 14 that connects the tip of the arm 12 and one end of the brush support 13 in a freely rotating manner, an operating portion 15 provided slidably at the other end of the handle member 3, and a second hinge 16 that connects the tip of the operating portion 15 and the other end of the brush support 13 in a freely rotating manner.

12 Claims, 7 Drawing Sheets

(a)

(b)

INTERDENTAL BRUSH

CROSS REFERENCE TO RELATED APPLICATIONS

This application claims the benefit of International Patent Application No. PCT/JP2004/016727, filed Nov. 11, 2004, which claims priority of Japanese Patent Application No. 2003-383772, filed Nov. 13, 2003.

TECHNICAL FIELD

This invention relates to an adjustable interdental brush with a cap that can be attached and detached regardless of the brush body angle.

BACKGROUND

The interdental brushes generally known and used consist of a handle and a brush body formed of a thin metal wire strand folded and twisted wherein a filament is captured between the wire. The brushes are generally cylindrical or cone-shaped and the handle is generally synthetic and often cylindrical of appropriate size to hold in the hand. A wire base of the brush body is often fixed onto the handle using methods such as insert molding and other physical joining methods including thermal fusion by high frequent and ultrasonic waves to integrate the brush body with the handle.

The problem with such conventional interdental brushes is that the base was often bent to fit into the gap between teeth to insure the best angle between the handle member and the brush. Repeating this procedure will damage the wire quite easily in a fairly short time period.

As a proposed solution, some interdental brushes have a handle, and a brush support member to fix and hold the brush body, with the tip of the handle branched in two on which the brush support member is pivotally supported in a freely rotating manner. (See Kokai Disclosure No. 9-121942 (Patent Document 1). However, such interdental brushes have the problem of increased manufacturing costs due to the increased number of parts necessary to make the brush support member.

Another type of interdental brush has been proposed in which the handle is made of two sub-handles, right and left sub-handles symmetrically centered on a common axis to form one handle, with the tip of both sub-handles fixed via five rings with a wire support. (See Kokai Application No. 8-508179 (Patent Document 2).

The interdental brush shown in Patent Document 2 adjusts the angle of the brush body against the handle by sliding the right and left sub-handles in the direction of the handle by which operation the cleaning action is enhanced. By forming the handle member so that these two sub-handles can open at an angle of 180°, the handle can be formed in one process whereby the number of parts and costs incurred are reduced.

Patent Document 1: Kokai Disclosure No. 9-121942

Patent Document 2: Kokai Application No. 8-508179

SUMMARY

However, the problem with the interdental brush shown in Patent Document 2 lies in the fact that the handle member must be cast with the two sub-handles in the open position. This requires the surface area of the mold to be more than twice as large as that required for a conventional handle, negatively impacting productivity of manufacture. Moreover, to make a handle a convenient length to hold, a large mold is required, resulting again in increased cost. In addition, as this toothbrush adjusts the brush body by sliding the sub-handles, it is not easy to use due to the potential risk of accidentally sliding the sub-handle while using the interdental brush. As a result, interdental brushes made this way are generally small in size and hard to use.

Here, an adjustable brush, which is easy-to-handle, cost-competitive and has a cap attachable to the brush regardless of its angle is disclosed.

The interdental brush which meets the above requirements is one having a brush body and a handle member. The handle member consists of a handle, an arm extending from one end of the handle along the length of the handle, a brush support that holds the base of the brush body, a first hinge that connects the tip of the arm and one end of the brush support in a freely rotating manner, an operating portion situated in a position-changeable manner at the other end of the handle member and slidable along the length of the handle, and a second hinge that connects the tip of the operating portion and the other side of the brush support in a freely rotating manner. Changing a position of the operating portion along the handle's length enables the user to rotate the brush body about the hinge.

The interdental brush may have a cap comprising a cap body covering the entire brush body, a cap base that is removably attachable to the brush support, and an opening formed by the cap base and cap body to cover the brush and the brush support. The cap preferably has an opening extending the length of the cap body and cap base to cover the entire brush body and brush support from the back.

When the operating portion of the interdental brush has a sliding portion at the other end of the handle member that moves along the length of the handle, and when the above-mentioned position changing is done by sliding, moving the slide gives an optimum angle for the brush body depending on the gap between the teeth. This movement can be done easily and in a stable manner while holding the handle, with or without attaching the extension pipe. Thus, the operational performance of the interdental brush can be improved by fitting its brush angle to the gap between the teeth.

Adding the position support means between the handle and the operating portion to keep the brush support at first and second positions centered on the first hinge can hold the brush at these switch-over positions, giving stability of the brush while cleaning, and hence, the operation of the brush can be enhanced by adjusting the brush angle to the optimum position.

Connecting the tip of the arm to one end of the brush support via the first hinge and the tip of the operating portion and the other end of the brush support via the second hinge can hold the brush support at the alternative two positions centered on the first hinge, and the position of the brush body is stabilized while in operation and hence the operational performance of the brush is enhanced. In other words, for example, depicting the brush support as a square will locate both hinges at the ends of the diagonal line of the brush support, giving a distance between both hinges larger than that for the end-to-end length of the brush base. Thus, sliding the operating portion will generate a large slide friction due to the sideways movement, resulting in the operating portion being easy to hold at either of the two positions, and the brush support to be held in the two switch-over positions.

The cap for the interdental brush comprises a cap body covering the entire brush and a detachable cap base that fit onto the brush body and brush support from the back. Thus, the cap fits quite easily and safely onto the brush body and brush support of the brush using the opening in the cap body and cap base. This is a benefit for elderly people with poor eyesight. In addition, because the cap is fitted to the brush support, the brush body angle can be adjusted easily and sanitarily while the cap is on it without using bare hands. Because the cap can be fitted to the toothbrush while holding the brush body at any angle, the brush can be stored while the brush body is disposed at any angle relative to the handle.

References to directions (e.g., left/right, up/down) refer to the orientation within the various figures shown herein and are for convenience only. They should not be used to limit the invention.

The productivity of manufacture of this interdental brush is increased and its cost reduced, as the handle, arm, brush support, operating portion, and hinges are integral parts of the handle member and can be molded in one process using synthetic resin. In addition, the handle length can be adjusted, making it convenient to hold by changing its size and by adding an extension pipe to form the handle of the brush. As it does not require opening the handle members to 180 degrees, unlike the brush shown in Patent Document 2, it does not require a large mold and hence, an easy-to-handle brush can be manufactured quite cost-effectively. Moreover, by adjusting the position of the operating portion along the length of the handle, an optimized angle of the brush body can be obtained to fit in the gaps between teeth and cleaning performance can be improved. Also, operation of the interdental brush can be improved, as it allows to hold stably the handle or the extension pipe connected thereto by hand.

The cap for this interdental brush can fit the brush body and brush support with the cap body and cap base using the opening from the side, so that the cap can be attached to the brush for storage, whatever the angle of the brush body. Hence, the operation of attaching and detaching the cap from the toothbrush as well as the ease of storage with the cap attached can be enhanced. As the cap is held at the brush support, the brush angle can be adjusted with its cap on without touching the brush with bare hands, and the sanitary condition of the brush is maintained.

BRIEF DESCRIPTION OF DRAWINGS

FIG. 1(*b*) is a right side elevational view of the interdental brush of FIG. 1(*a*).

FIG. 2(*b*) is a cross-sectional view through line B-B of FIG. 1(*a*).

FIG. 3(*b*) is a partial perspective view of the operating portion.

FIG. 5(*b*) is a right side elevational view of the interdental brush of FIG. 5(*a*).

FIG. 6(*b*) is a front elevational view of the interdental brush of FIG. 6(*a*) at the second position.

FIG. 7(*b*) is a cross-sectional view through line C-C of FIG. 7(*a*); FIG. 7(*c*) is a right elevational view of the cap; and FIG. 7(*d*) is a partial front cross-sectional view of the cap and the interdental brush at the second position.

DETAILED DESCRIPTION

Listing of Reference Numbers

Figure 1:
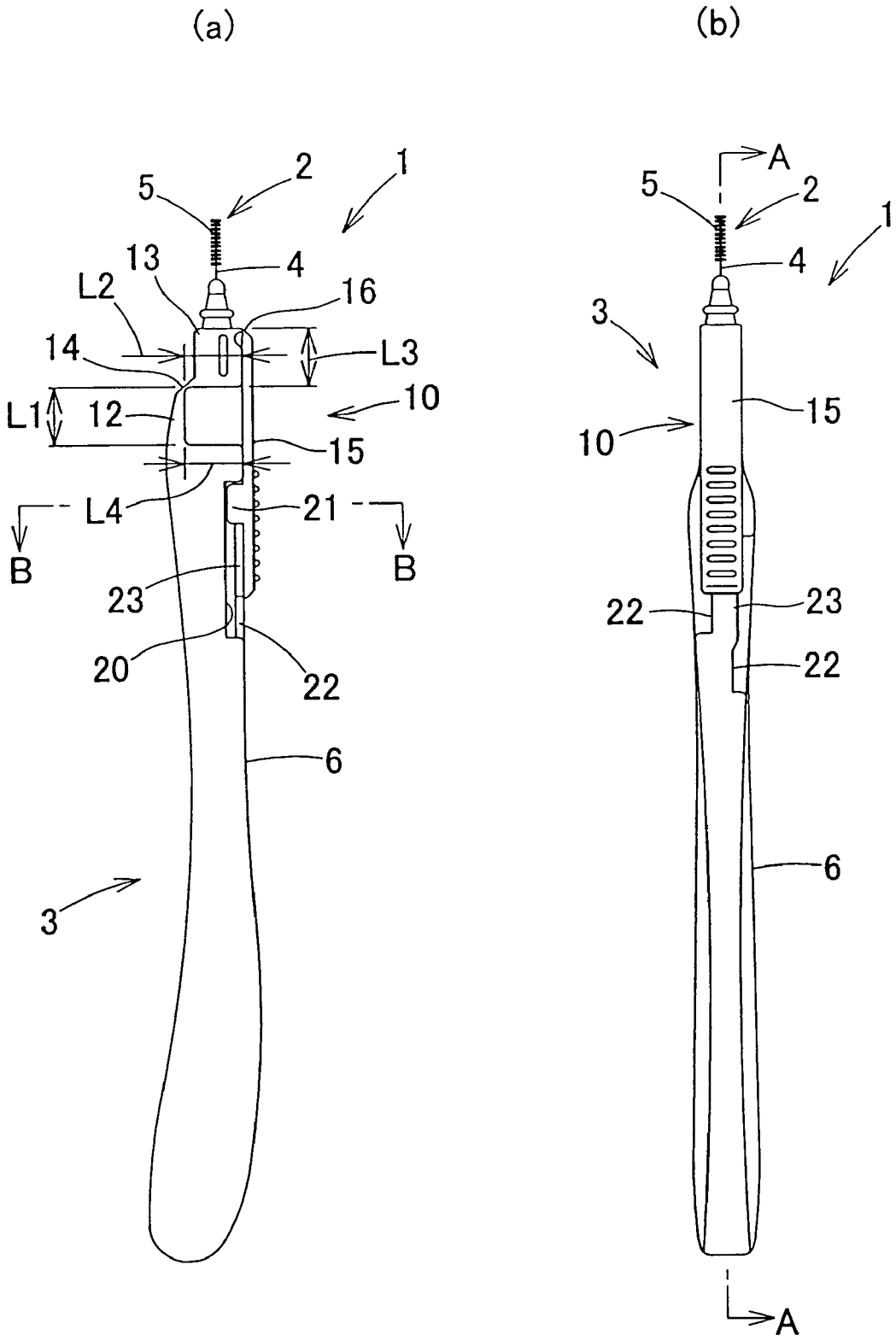
FIG. 1(*a*) is a front elevational view of the interdental brush.

1 Interdental brush
2 Brush body
3 Handle member
4 Wire
5 Brush
6 Handle body
10 Tiltable support portion
12 Arm
13 Brush support
14 First hinge
15 Operating portion
16 Second hinge
20 Slide guide
21 Stop
22 Cutout
23 Control portion
1A Interdental brush
3A Handle member
6A Handle body
15A Operating portion
30 Hole
31 Guiding plate
32 Slide hole
33 Engagement portion
34 Wider hole
1B Interdental brush
3B Handle member
6B Handle body
15B Operating portion
35 Recessed portion
36 Protrusion
50 Cap
51 Cap body
52 Cap base
53 Opening
54 Protrusion
55 Recessed portion As FIG. 1 shows, the interdental brush 1 is comprised of the brush body 2 including the brush 5 and the wire 4, and the handle member 3 supporting the brush body.

Figure 2:
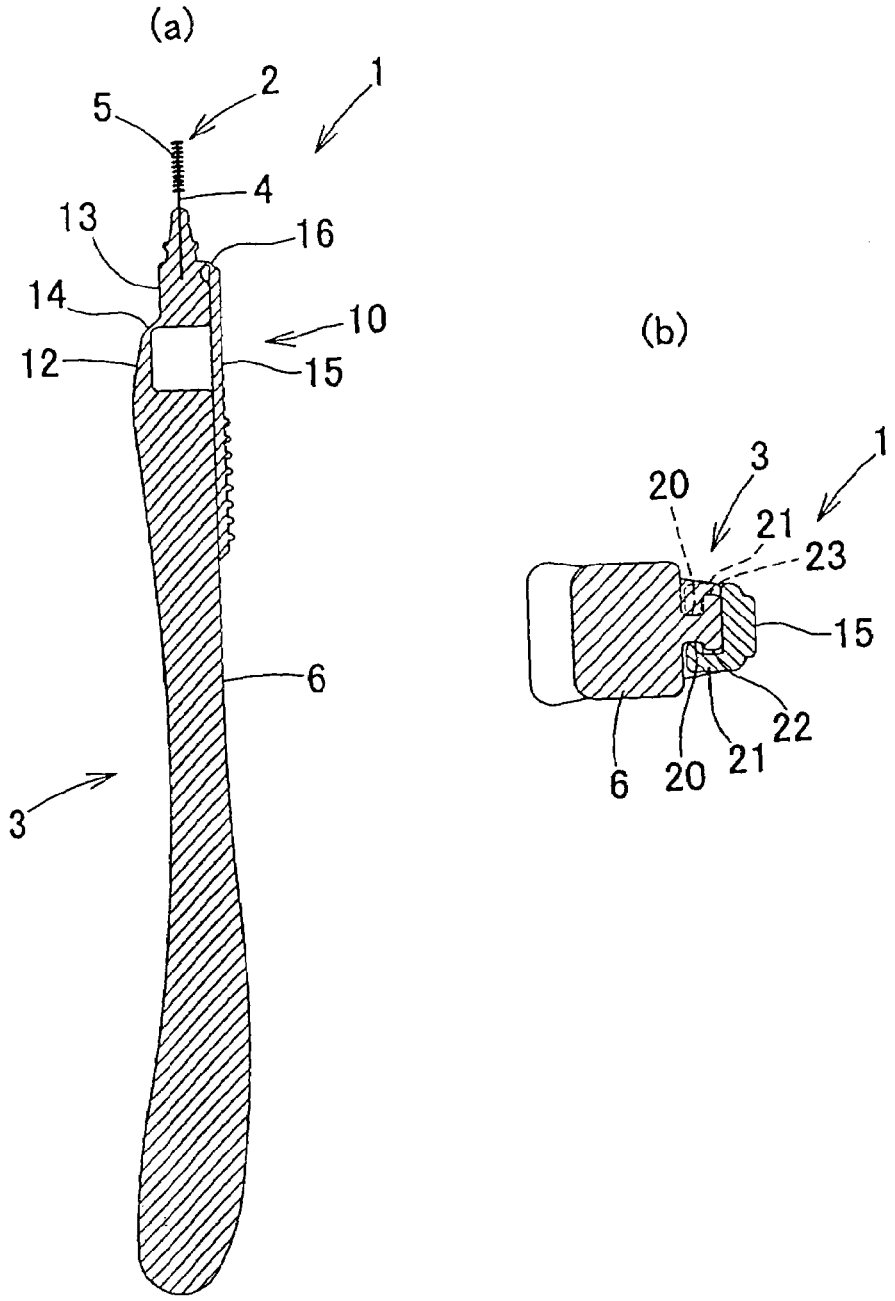
FIG. 2(*a*) is a cross-sectional view through line A-A of FIG. 1(*b*)
Figure 3:
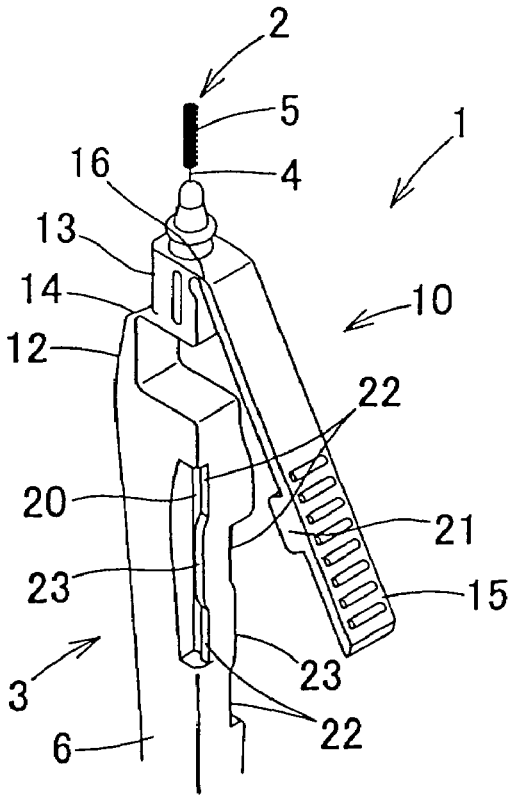
FIG. 3(*a*) is a partial perspective view of the tiltable support.
Figure 3:
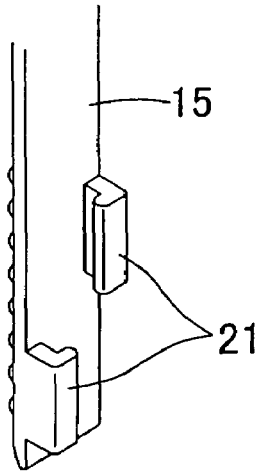
Figure 4:
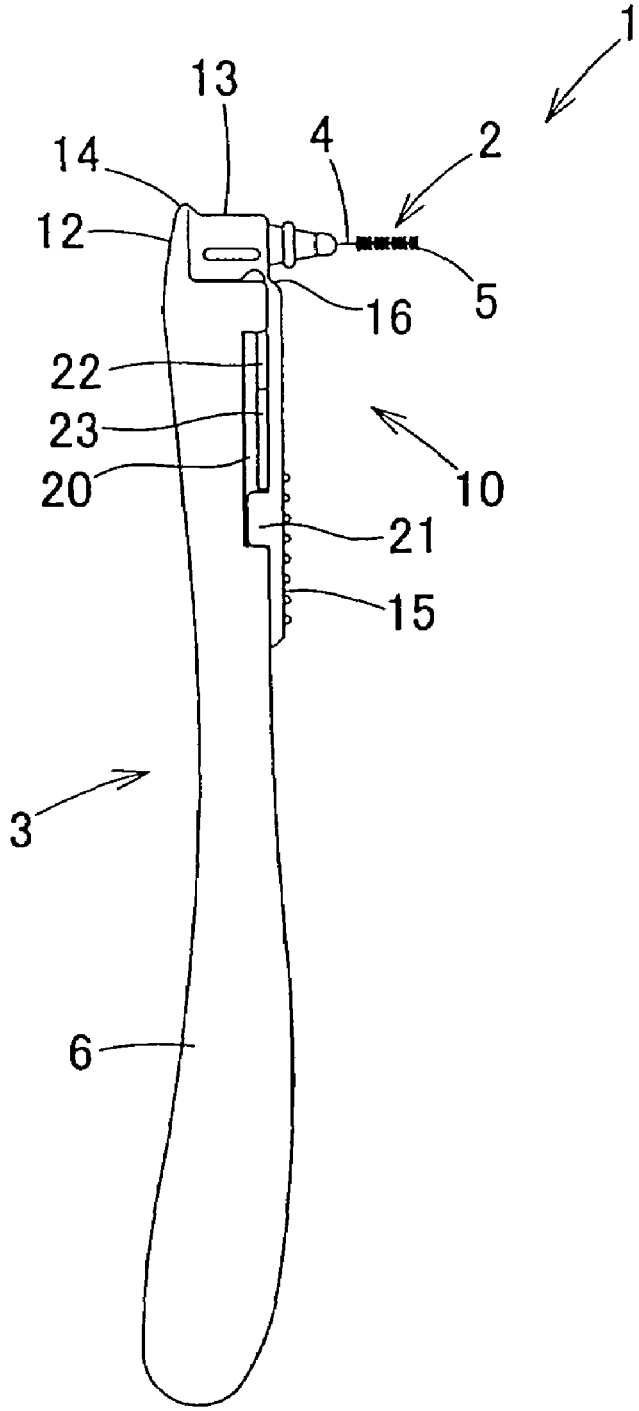
FIG. 4 is a front elevational view of the interdental brush at the second position.

The brush body 2 shown in FIGS. 1 and 2 is made of thin wire 4 strands folded and twisted, and filaments captured radially by the wire 4, in a well-known configuration. The profile of the brush 5 can be either cylindrical or conical. It can also be barrel-shaped with the outer diameter of the middle portion of the brush larger than that of the top or the bottom of it. The brush body 2 and handle can be made by a one-shot molding of synthetic resin, including the brush and its core support.

As FIGS. 1 to 4 show, the handle member 3 comprises a elongated handle 6 of appropriate size to hold in the hand and a tiltable support portion 10 attached to the upper end of the handle 6. The brush body 2 is connected to the handle 6 in a freely movable manner by way of the tiltable support portion 10. The handle member 3 is made of synthetic resin having a property capable of withstanding repeated bending of an integrally formed hinge and enough strength to serve as a handle, such as polyethylene, polypropylene or thermoplastic elastomer, and the handle member 3 is formed by one-shot molding by a method such as injection molding.

As shown in FIGS. 1(*a*) and 2(*a*), the tiltable support portion 10 consists of an arm 12 extending upward from the left end (one side at the tip) of the upper, roughly even surface of the handle 6, a brush support 13 with the bottom (the proximal end) of the wire 4 of the brush body 2 fixed therein, a first hinge 14 connecting the upper end of the arm 12 and left bottom end of the brush support 13 which rotate freely with respect to each other, an operating portion 15 at the right side (other side) of the handle member 3 in a manner that is freely slidable along the length of the handle 6, and a second hinge 16, comprising an integrally formed hinge, that connects the upper end of the operating portion 15 and the right upper end of the main body of the brush support 13 in a freely rotating and movable manner. The position of the brush support 13 is supported in a range of about 90 degrees centered on the first hinge 14 in a freely rotating and movable manner by operating the operating portion 15 upward or downward, between in a first position in FIG. 1(*a*) with the brush body 2 directed upward or downward and in a second position in FIG. 4 with the brush body 2 directed left or right direction.

As FIG. 1 shows, the L1 length between the proximal end of the arm 12 and the first hinge 14 is almost equal to or slightly longer than the L2 length between the right end of the bottom of the brush support 13 and the first hinge 14. The L3 length between the bottom of the brush support 13 and the second hinge 16 is almost equal to or slightly longer than the L4 length between the right end of the handle 6 and the arm 12. In addition, the upper surface of the handle 6 and the right surface of the arm 12 almost form a right angle. The same is true in the case of the angle between the lower surface of the brush support 13 and the right surface of the brush support 13. When the brush support 13 is in the first position shown in FIG. 1(*a*), the angle between the lower surface of the brush support 13 and the right surface of the arm 12 is almost at a right angle, whereas when the brush support is in the second position shown in FIG. 4, the lower surface of the brush support 13 is almost in contact with the right surface of the arm 12 (the lower side in FIG. 1) and the bottom surface of the brush support 13 is almost in contact with the upper surface of the handle 6 (the lower right side in FIG. 1). In addition, in this second position, the second hinge 16 moves closer to the right end of the upper surface of the handle 6.

In this embodiment, the lengths and angles described above are for the purpose of enabling the rotation of the brush body 2 between the first and second positions shown in FIGS. 1(*a*) and 4 over a range of rotation of approximately 90°. However, the range of rotation of the brush body 2 can be altered by changing these lengths and angles.

In order to enable the operating portion 15 to slide only upward and downward freely along the handle 6, a pair of slide guides 20 is formed extending along the upper handle 6. A pair of stops 21 are formed on the opposite sides and at the lower end of the operating portion 15 to slidingly grip and fit into slide guides 20. The operating portion 15 is thus slidingly fitted to the handle portion 6 with the stops 21 freely movable in the slide guides 20.

The front and the rear stops 21 are not disposed directly opposite each other, but are staggered a distance in an upward and a downward direction with respect to each other as are the front and the rear slide guides 20 in order to accommodate the stops 21 so that the handle member 3 can be molded by a pair of molds. It is possible to locate the stops 21 and slide guides 20 symmetrically in the front and the rear direction with respect to the handle 6, though this would require slightly different molding configurations.

Cutouts 22 are formed in each of the upper and the lower portion of the slide guides 20, and the operating portion 15 can be fit onto the handle 6 by engaging the front and the rear stops 21 through the cutouts 22 into the slide guides 20 one after another, using the elasticity of the operating portion 15. The control portion 23 is located between the upper and lower cutouts 22 which blocks the movement of the operating portion 15 downward by engaging the control portion 23 with the base of the stops 21, when the brush body 2 is at the first position by moving the operating portion 15 upward, and which blocks the movement of the operating portion 15 upward by engaging the control portion 23 with the base of the stops 21, when the brush body 2 is at the second position by moving the operating portion 15 downward. To move the operating portion 15 from the upper position to the lower position, or vice versa, the operating portion 15 should be forced to push upward or downward against the elasticity of the material beyond the control portion 23 to move the stops 21 to upper or lower cutouts 22. A position maintaining means of the interdental brush 1 is structured by the cutouts 22, control portion 23 and stops 21.

The interdental brush 1 is designed so that moving the operating portion 15 upward will make the brush body 2 and the brush support 13 rotate to the first position as shown in FIG. 1 about the first hinge 14, whereas moving the operating portion 15 downward will make the brush body 2 and the brush support 13 rotate to the second position about the first hinge 14. By rotating the position of the operating portion 15, cleaning can be done by changing the position of the brush body 2 to best suit the gap between the teeth. When the brush body 2 is in the first or second positions, the stops 21 on the operating portion 15 will engage the control portion 23 and cleaning can be done by stabilizing the brush body 2 at the appropriate position. The frictional engagement of the stops and slide guides is such that there is sufficient resistance that the angle of the brush body does not readily change during use, but the angle can be readily changed by the user. The ridges shown on operating portion 15 provide a tactile way for the user to overcome the frictional engagement and change the angle.

In the preferred embodiment, an interdental brush 1 with a handle 6 of appropriate length for ease of handling is provided. However, other battery-driven interdental brushes or other handles can be used by adding a short detachable extension pipe, and the brush can substitute for any other battery-driven interdental brush. Here, the brush body 2 is permanently fixed to the handle member 3 by embedding a wire 4 in the brush support 13. However, it is also applicable to a system in which the brush body 2 can be replaced. It's also possible to engage a brush integrally formed with a brush body and a brush support to a handle member by using stops means.

Figure 5:
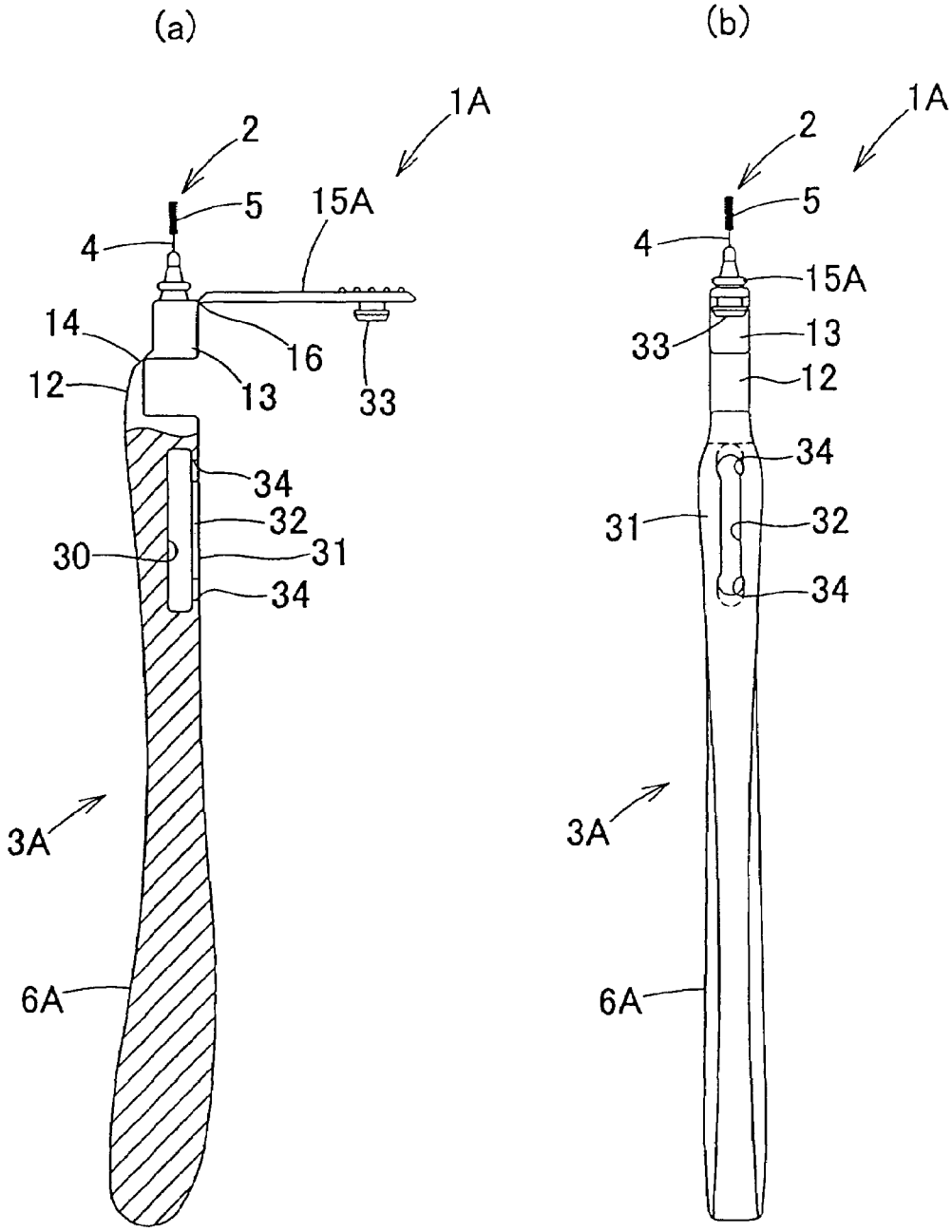
FIG. 5(*a*) is a partial front cross-sectional view of a second embodiment of the interdental brush.

In another embodiment, as shown in FIG. 5, the interdental brush 1A has a handle member 3A with an elongated hole 30 extending through the front and rear sides of the body at the upper right of the handle 6A. A guiding plate 31 is attached at the right of the hole 30. A narrow slide hole 32 in the middle of the guiding plate 31 is in communication with hole 30 to accept the engagement portion 33 that protrudes from the free end of the operating portion 15A. Wider holes 34 are located at the upper and lower ends of the slide hole 32. In this embodiment, when the engagement portion 33 is fitted into the upper large hole 34, the brush body 2 together with the brush support 13 is kept in the first position. When the engagement portion 33 is engaged in the lower large hole 34, the brush body 2 together with the brush support 13 is kept at the second position. Moving the operating portion 15A upward and downward will move the engagement portion 33 through the narrowed portion of the slide hole 32 to move to the upper or lower large holes 34 to keep the brush body 2 at the first or second positions changeably.

Figure 6:
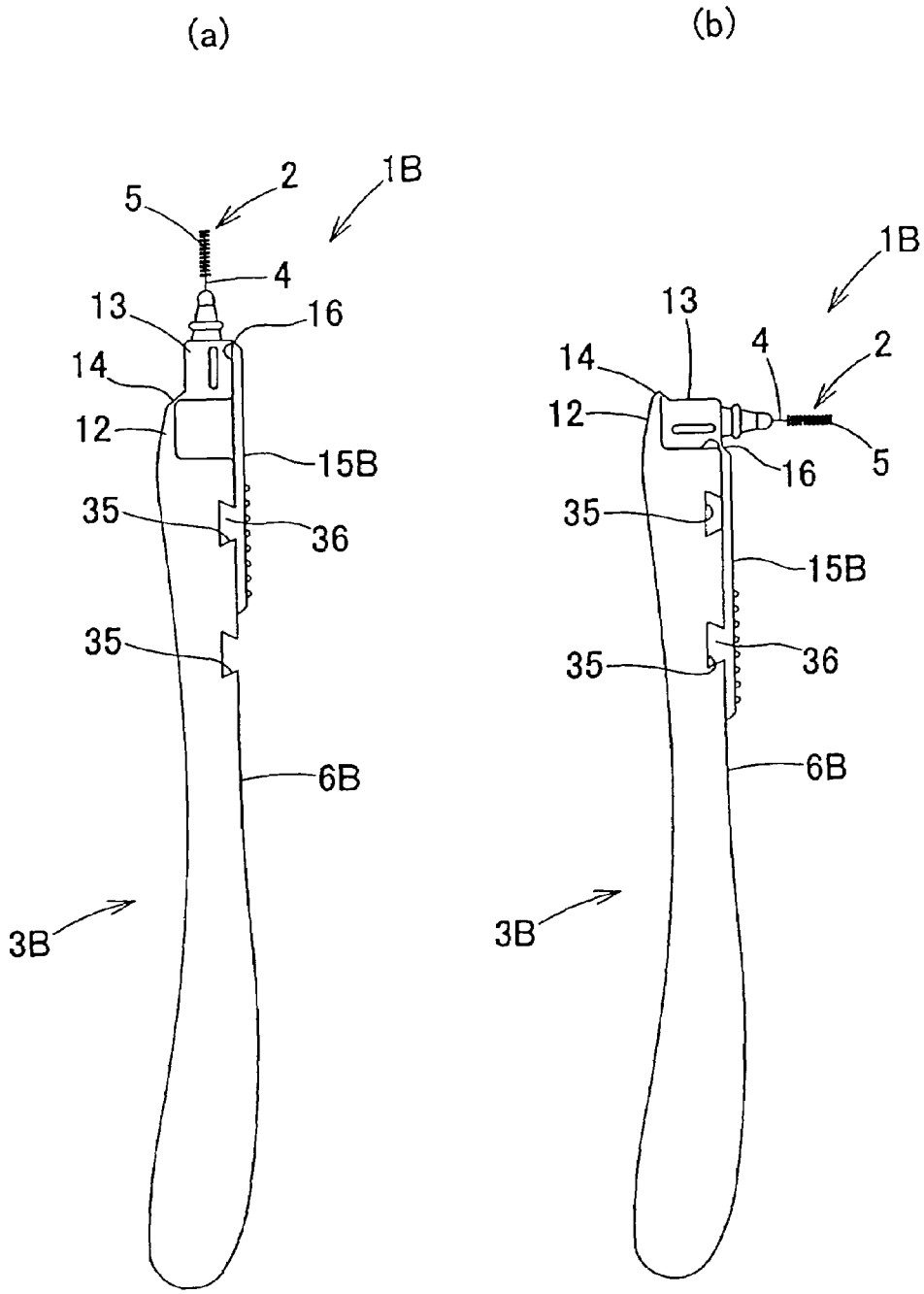
FIG. 6(*a*) is a front elevational view of a third embodiment of the interdental brush at the first position.

In another embodiment, the handle member 3B of the interdental brush 1B as shown in FIG. 6, has more than one recessed portion 35 in the shape of, for example, a dovetail groove. The recesses 35 are located at intervals along the upper right surface of the handle 6B to receive the protrusion 36 on operating portion 15. When the protrusion 36 is engaged in one of the recesses 35, the brush 2 is held in the first or second position. To rotate the brush 2, the protrusion is disengaged from the recess and the operating portion 15 is moved so that the protrusion 36 is engaged with the other recess 35. Any number of recesses 35 can be formed in the handle 6B to hold the brush 2 in a plurality of different positions. In this embodiment, the brush body 2 is structured in a position-changeable manner between the first and the second position by moving the operating portions 15, 15A and 15B upward or downward. But it's also possible to make a structure capable of being changed in a plurality of positions, more than one.

The cap 50 can be used for interdental brush 1, 1A and 1B, as well as other types of interdental brushes. As FIG. 7 (*a*) shows, the cap 50 consists of a cap body 51 that covers the entire brush body 2 and a cap base 52 that engages the brush support 13. An opening is provided at the right side of the cap body 51 so that the cap 50 may be placed over the brush 2 and brush support 13.

Figure 7:
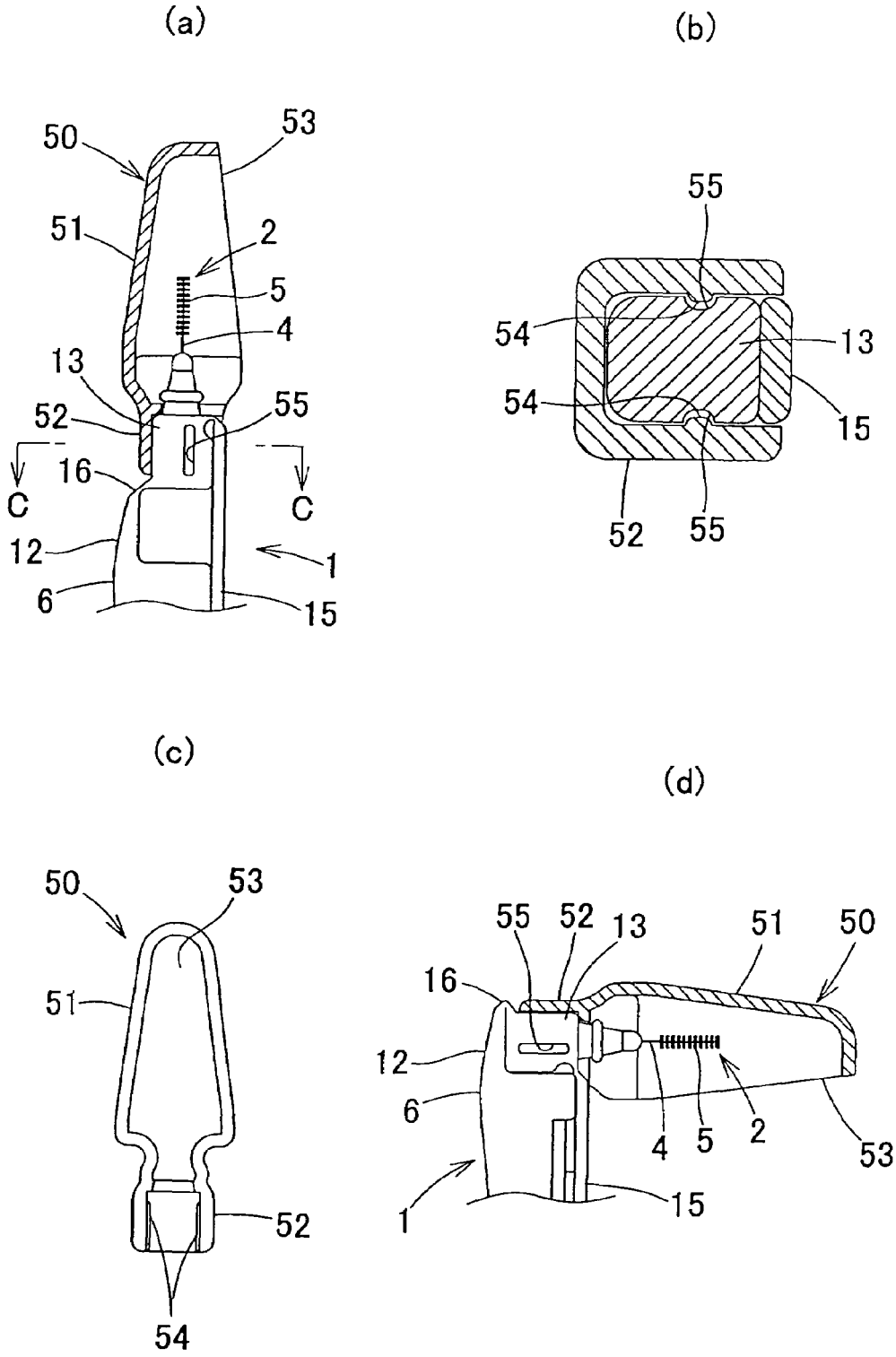
FIG. 7(*a*) is a partial front cross-sectional view of the cap and the interdental brush at the first position.

As FIGS. 7 (*b*) and (*c*) show, long thin protrusions 54 are formed on the front and rear opposite sides of inner surface of the cap base 52. The front and rear sides of the brush support 13 are provided with recessed portions 55 to receive the protrusions 54. The cap 50 is fitted to the brush support 13 by engaging the protrusions 54 with the recessed portions 55 so that the cap may be attached and detached from the brush support 13. The cap 50 thus may cover the entire brush body 2 and the brush support 13. Alternatively, a hook system can be used to engage the cap base 52 to the brush support 13.

The cap 50 can be fitted to the interdental brush 1 while holding the brush body 2 and the brush support 13 in the first position as shown in FIG. 7 (*a*) or the second position as shown in FIG. 7 (*d*) and the interdental brush 1 can be stored in these respective positions with the cap 50 on. Therefore, the ease of fitting the cap 50 onto the interdental brush 1 and the ease of storing the interdental brush 1 with the cap 50 on is significantly enhanced. In addition, as the cap base 52 engages the brush support 13 to fix the cap 50 to the brush support 13, the angle of the brush body 2 is adjustable while the cap 50 is on, to maintain sanitary conditions without touching the brush body 2.

The embodiments described above and illustrated in the figures are presented by way of examples only and not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. An interdental brush comprising:

a handle;

a brush body;

a brush support for holding the brush body;

an arm connected at one end to the handle and hingedly connected at the other end to a lower portion of the brush support on a first side of the brush support; and an operating portion hingedly connected to an upper portion of the brush support on a second side of the brush support and slideably connected to the handle for movement in a longitudinal direction of the handle for rotating the brush support relative to the handle in a range of about 90 degrees.

2. The interdental brush according to claim 1, including a mechanism formed on the handle and cooperating with the operating portion for moving the brush support between a first and second position and holding the brush support at either position.

3. An interdental brush according to claim 1 or 2, including a removable cap comprising a cap body which covers the brush body and a cap base which connects to the brush support, and the cap body and the cap base having an opening which allows capping the brush body and brush support.

4. The interdental brush according to claim 3, wherein friction between the operating portion and the handle is sufficiently low to permit movement of the operating portion relative to the handle, but sufficiently high to prevent unwanted movement of the brush body during use of the interdental brush.

5. The interdental brush of claim 3, wherein the opening in the cap allows capping the brush body and brush support from the side.

6. The interdental brush of claim 3, wherein the cap can be attached to the interdental brush regardless of the position of the brush support.

7. The interdental brush of claim 3, wherein the cap includes at least one protrusion, and the brush support includes at least one recess, and wherein the cap is removably coupled to the brush support by engaging the protrusion with the recess.

8. The interdental brush of claim 7, wherein a pair of slide guides are provided along the length of the handle and the operating portion includes at least one stop that fits into and slides within the slide guides, and wherein the at least one stop limits movement of the operating portion within the guides and wherein the operating portion is slideable along the length of the handle.

9. An interdental brush having a brush body and a handle member, the handle member comprising:

a handle having a first side and a second side;

an arm extending in a longitudinal direction from the first side of the handle and having a tip;

a brush support that holds the brush body, the brush support including an upper end, a lower end, a first side, and a second side;

a first hinge that connects the tip of the arm and the first side of the brush support at the lower end of the brush support in a freely rotating manner;

an operating portion situated in a position-changeable manner at the second side of the handle and longitudinally slideable along a portion of the handle, the operating portion having a tip; and a second hinge that connects the tip of the operating portion and the second side of the brush support at the upper end of the brush support in a freely rotating manner, wherein changing a longitudinal position of the operating portion relative to the handle enables a user to rotate the brush body relative to the handle.

10. The interdental brush of claim 9, wherein a pair of slide guides are provided along the length of the handle and the operating portion includes at least one stop that fits into and slides within the slide guides, and wherein the at least one stop limits movement of the operating portion within the guides and wherein the operating portion is slideable along the length of the handle.

11. The interdental brush of claim 10, wherein the at least one stop includes a pair of longitudinally spaced-apart stops positioned on opposite sides of the operating portion.

12. The interdental brush of claim 9, wherein the operating portion and handle have a plurality of cooperating protrusions and recesses that are located at intervals along the length of the handle and that allow the operating portion to be moved to these locations along the length of the handle and thereby to move the brush body through a plurality of positions.

* * * * *